United States Patent [19]

Autry

[11] Patent Number: 4,670,949

[45] Date of Patent: Jun. 9, 1987

[54] STAGGERED SPEED LACE EYELETS AND METHOD OF LACING

[75] Inventor: James C. Autry, Dallas, Tex.

[73] Assignee: Autry Industries, Inc., Dallas, Tex.

[21] Appl. No.: 793,852

[22] Filed: Nov. 1, 1985

[51] Int. Cl.[4] ..... A43B 11/00; A43C 1/04

[52] U.S. Cl. ..... 24/140; 24/141; 36/50

[58] Field of Search ..... 24/140, 141, 117, 145, 24/146, 147; 36/50, 97

[56] References Cited

U.S. PATENT DOCUMENTS

| | | | |
|---|---|---|---|
| 354,668 | 12/1886 | Taylor | 24/140 |
| 889,770 | 6/1908 | Dorothy | 24/147 |
| 1,057,382 | 3/1913 | Kramer | 24/140 |
| 1,296,530 | 3/1919 | Koester | 36/50 |
| 1,850,781 | 3/1932 | Weingarten | 24/140 |
| 2,469,708 | 5/1949 | Alexander | 24/140 |
| 4,507,878 | 4/1985 | Semouha | 24/140 |
| 4,538,367 | 9/1985 | Adams | 24/140 |
| 4,553,342 | 11/1985 | Derderian et al. | 36/50 |
| 4,559,723 | 12/1985 | Hamy et al. | 36/50 |

FOREIGN PATENT DOCUMENTS

| | | | |
|---|---|---|---|
| 129917 | 1/1985 | European Pat. Off. | 24/140 |
| 239755 | 7/1910 | Fed. Rep. of Germany | 24/140 |
| 3136 | of 1883 | United Kingdom | 24/140 |

*Primary Examiner*—Victor N. Sakran

*Attorney, Agent, or Firm*—Jerry W. Mills; Jefferson Perkins

[57] ABSTRACT

A laced shoe (10) having a left quarter (20) and a right quarter (18) has first and second sets of eyelet pairs (38) and (42) mounted respectively on said left and right quarters (20) and (18). The sets (38) and (42) include a set of large eyelets (62) and a set of small eyelets (68). A pair of large eyelets (62) are interposed between pairs of small eyelets (68).

12 Claims, 7 Drawing Figures

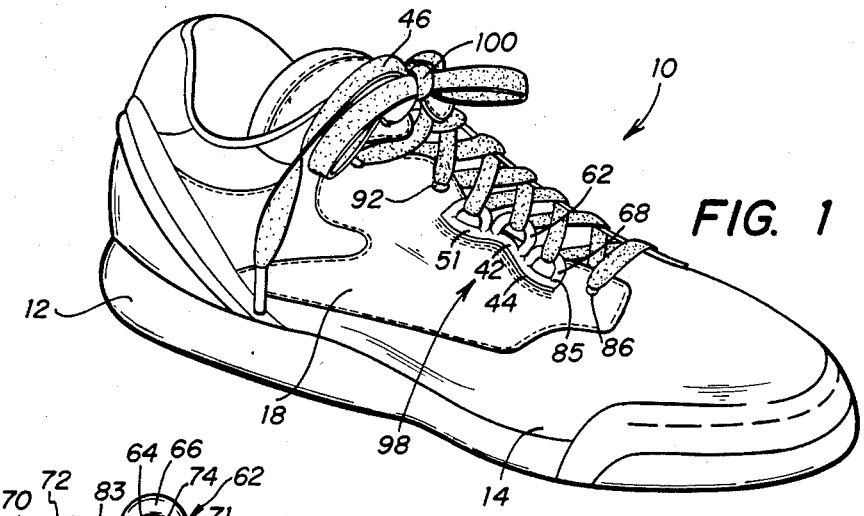
FIG. 1
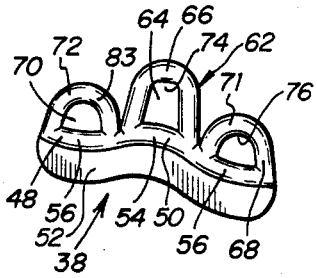
FIG. 2
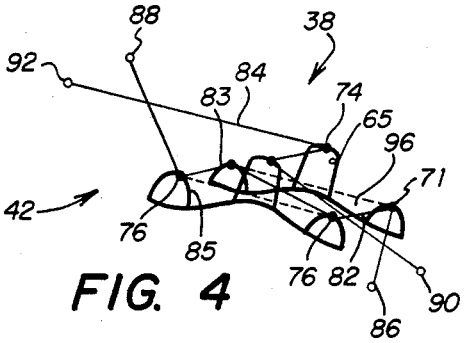
FIG. 4
FIG. 3
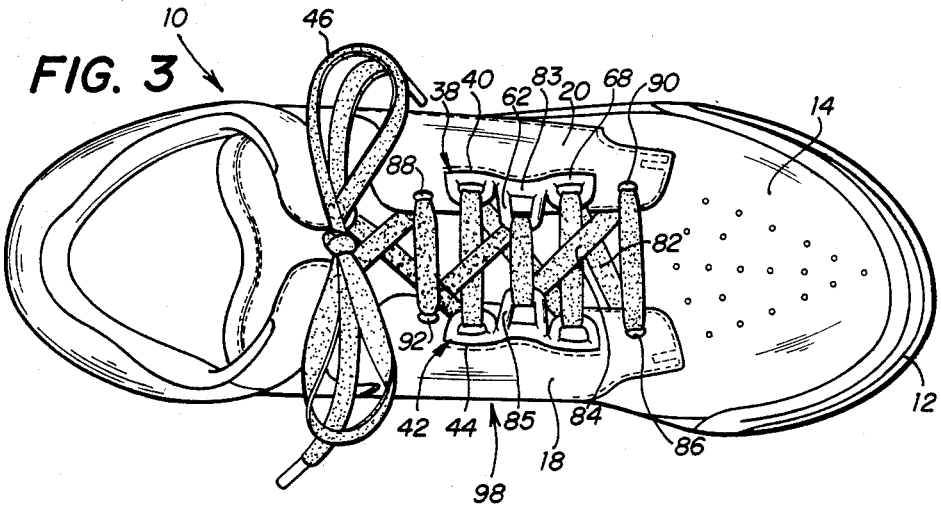

STAGGERED SPEED LACE EYELETS AND METHOD OF LACING

TECHNICAL FIELD OF THE INVENTION

This invention relates in general to shoe laces and eyelets, and relates more particularly to eyelets and lacing methods for speed lacing which give a better fit to feet with either high or low insteps.

BACKGROUND OF THE INVENTION

It is known in the art to provide a set of large eyelets for lace-up shoes to close the left quarter of the shoe to the right quarter. Certain types of athletic shoes and hiking shoes have large numbers of pairs of eyelets that have interiors that are large enough to loosely receive the shoe lace, thus allowing a quick tightening of the lace without laboriously pulling each section of lace between two eyelets.

Heretofore, large speed lace eyelets have been provided in one uniform size and have been arranged in straight lines down the right and left shoe quarters. While conventional speed laces allow the quick lacing and tightening of the shoe, they permit a quick lacing only in the most common lacing pattern. In the common pattern, each lace half is laced from a left eyelet diagonally upward to a right eyelet in an adjacent eyelet pair, and thereafter from the right eyelet diagonally upward to the left eyelet of the next eyelet pair, and so on to complete the lacing. Often, this common form of lacing does not yield the best fit of the shoe to the foot. However, it alternate lacing schemes are attempted, the speed lacing effect is lost, as the laces bind on each other upon pulling the laces taut from the top of the eyelet pairs.

Another problem in providing straight rows of eyelets in athletic shoes is that they are designed to fit only one standard instep. Persons with feet having high insteps find straight-row speed-laced shoes too constricting when the laces are pulled tightly. Persons with low insteps will find that their conventional shoes are too loose.

There thus exists a need to provide speed lace eyelets which will allow the wearer to use alternate lacing patterns, and there also exists a need to provide a set of speed lacing eyelets which will provide the best fit for feet having either a low instep or a high instep.

SUMMARY OF THE INVENTION

The present invention provides a shoe with a left quarter and a right quarter and first and second sets of eyelets mounted on the left and right quarters, respectively. The eyelet sets each include first and second eyelets arranged in pairs. A pair of first eyelets is interposed between two pairs of second eyelets so that the first and second eyelet pairs alternate up the closure of the shoe. The upward portions of the interiors of the eyelets receive the lace when the lace ends are drawn tight, leaving the remainder of the speed lace eyelet interiors empty. The first eyelet upward portions lie within a first plane and the second eyelet upward portions define a second plane vertically spaced from the first plane.

The shoe can be laced with a lace having a first portion and a second portion, the first portion using eyelets in the first set but not eyelets in the second set and the second portion using eyelets in the second set but not eyelets in the first set. With the two portions, two planar lacing patterns result which are vertically separated from each other by a distance sufficient to reduce the friction between them. This reduces binding of the laces on each other, and thus allows speed lacing of the shoe using an alternate lacing pattern.

Preferably, the eyelet pairs of the present invention provide an integral eyelet section among the eyelets disposed in or on the upper left and right quarters of the shoe. When the wearer chooses to lace up the shoe using the first eyelets and not the second eyelets, the left quarter of the shoe will be laced to the right quarter along the integral eyelet section at a relatively high position to better fit a foot having a high instep. When the wearer chooses to lace up the shoe using the second eyelets and not the first eyelets, the left quarter will be joined to the right quarter at a relatively low position in order to better fit a foot with a low instep. Use of both the first and second eyelets will close the shoe at an intermediate position to fit a foot having an instep of intermediate height.

BRIEF DESCRIPTION OF THE DRAWINGS

For a more complete understanding of the present invention and the advantages thereof, reference is now made to the following detailed description taken in conjunction with the accompanying drawings in which:

FIG. 1 is a perspective view of an athletic shoe provided with the eyelets of the invention, the shoe being laced using the most common pattern;

FIG. 2 is a detail of a preferred form of a set of left eyelets of the invention as incorporated into a left eyelet-bearing member;

FIG. 3 is a plan view of the shoe shown in FIG. 1, showing a first alternate lacing pattern;

FIG. 4 is a schematic perspective diagram of the eyelets and lacing pattern shown in FIG. 3, showing disposition of two lace portions in separated planes;

DETAILED DESCRIPTION OF THE INVENTION

Figure 5:
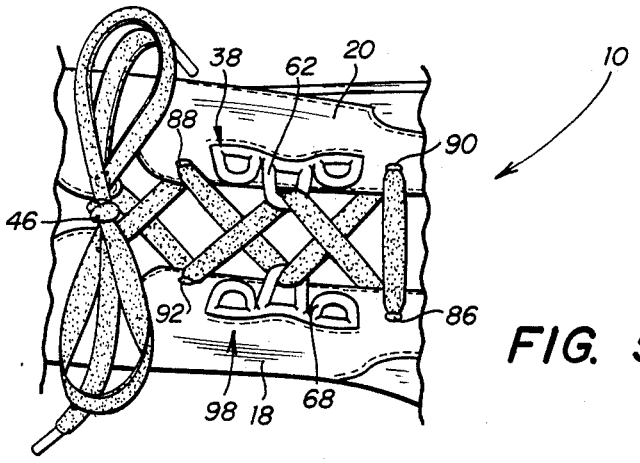
FIG. 5 is a partial plan view of the shoe shown in FIG. 1, showing a second alternate lacing pattern.

Referring now to FIG. 1, there is shown a shoe 10 which, in this illustrated embodiment, is an athletic shoe. Shoe 10 has a sole 12, to which is attached as by gluing an upper 14. Upper 14 can be constructed of a flexible material such as leather out of several components. Upper 14 has a right quarter 18 and a left quarter 20 (FIG. 3).

A left eyelet bearing member 38 (FIG. 3) is inserted into a slit 40 in the left quarter 20 and is stitched in place. A right eyelet-bearing member 42 is inserted into and stitched to a slit 44 in right quarter 18. Eyelet-bearing members 38 (FIG. 3) and 42 are each preferably integrally constructed of a rigid, durable material such as plastic or metal. A lace 46 may be of any known type such as cloth or leather, and is shown in FIG. 1 lacing left quarter 20 to right quarter 18 in the most common lacing pattern. Eyelet-bearing members 38 (FIG. 2) and 42 each have at least a pair of small eyelets 68 and a large eyelet 62 which are integrally and upstandingly formed on sinuous base members 51 and 50. Alternatively, eyelets 62 and 68 could be directly formed in upper left and right quarters 20, 18, but the illustrated method of formation is preferred.

Referring to FIG. 2, left eyelet-bearing member 38, a mirror image of right eyelet-bearing member 42, is depicted in more detail. A lip member 52 is preferably formed as an integral downward extension of base member 50. Lip member 52 is inserted into left slit 40 for attachment to the shoe as by stitching (FIG. 3).

Base member 50 is preferably formed so as to consist of at least one hill 54 and at least a pair of valleys 56. One of a set of first large eyelets 62 projects upwardly from each hill 54. Each large eyelet 62 has an enlarged eyelet interior 64 formed by enlarging its eyelet ring 66 from the usual semicircular shape to an oval shape or, as shown, a shape ending in a square-like formation. One of a set of second small eyelets 68 is formed in each valley 56, and has a smaller interior 70 and ring 72 than corresponding large eyelet interior 64 and ring 66. Small eyelet interior 70 has an upward dimension less than large eyelet interior 64. Large eyelet interior 64 has an upper portion 74 which will be filled with lace 46 when lace 46 is drawn tight. The remainder of large eyelet interior 64 will then be empty. Small eyelet interior 70 has a corresponding upper portion 76 to be filled by lace 46 upon tightening. As can be seen, upper portion 74 is substantially higher than the upper portion 76 in an adjacent small eyelet 68.

FIG. 3 shows the shoe 10 of FIG. 1, but with an alternate lacing pattern to provide better fit of the shoe for certain feet. A lace portion 82 is laced in a "Z" pattern through small eyelets 68, but not through large eyelets 62. A lace portion 84 is laced in another "Z" pattern over lace portion 82 through large eyelets 62 but not through small eyelets 68.

FIG. 4 schematically depicts the effect of providing a pair of staggered eyelet-bearing members 38 and 42 for use in accommodating the alternate lace pattern shown in FIG. 3. Upper eyelet portions 74 and 76 are here shown as points, and lace lengths 82 and 84 as lines, in order to better illustrate the geometry. Large eyelets 62 and small eyelets 68 are shown only to the extent of their interior margins 65 and 71. It will be noted that in any pair, a left eyelet 83 of the pair is not coplanar with a right eyelet 85. Both eyelets 83 and 85 stand at least to some extent upwardly in order that their upper portions 74 and 76 lie in different, roughly horizontal planes 94 and 96. Lace portion 82 is laced from a bottom eyelet 86 in a "Z" pattern through small eyelet upper portions 76 to a top eyelet 88. Overlaying this, lace portion 84 is laced from a bottom eyelet 90 in a "Z" pattern through large eyelet upper portions 74 to a top eyelet 92. First lace portion 82 stays roughly within plane 96 as it passes through and between small eyelet upper portions 76. Second lace portion 84 stays generally above and spaced from plane 96. Thus, first lace portion 82 is spaced from second lace portion 84 throughout the speed lace eyelet section.

Preferably, speed lace eyelets 62 and 68 comprise an integral section 98 among the eyelets in the shoe, as shown in FIGS. 1 and 3. Lace portions 82 and 84 can thus be tightened at top eyelets 88 and 92 without encountering a large amount of friction from each other within speed lace eyelet section 98. This allows lace lengths 82 and 84 to be tightened from the top throughout their lengths without binding.

Each large eyelet upper portion 74 should be closer to the horizontal level of a small eyelet upper portion 76 above it than to a small eyelet upper portion 76 below it. This relationship is shown in FIG. 1.

FIG. 5 partially shows shoe 10 as laced for a foot having a higher-than-normal instep. Lace 46 is laced from bottom eyelets 86 and 90 through large eyelets 62 and finally through the top eyelets 88 and 92. Lace 46 resides well above plane 96 (FIG. 4) after it is tightened. Small eyelets 68 are not used. Right quarter 18 is therefore joined by lace 46 to left quarter 20 at a relatively high location, which in turn allows shoe 10 to better fit a foot with a high instep.

Figure 6:
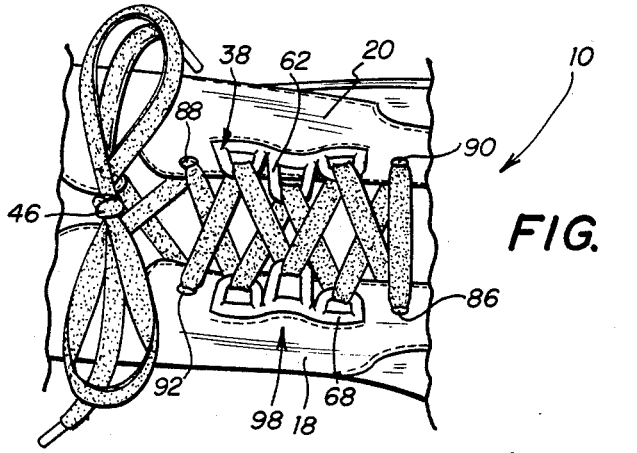
FIG. 6 is a partial plan view of the shoe shown in FIG. 1 as employing the most common lacing pattern.

FIG. 6 partially shows shoe 10 with a common lacing pattern. Since large eyelets 62 and small eyelets 68 are both used by lace 46, lace 46 will generally lie in a position somewhat above lower plane 96 (FIG. 4), but below the corresponding position shown in FIG. 5, in an intermediate position. This lacing pattern is appropriate for a foot having an instep of intermediate height.

Figure 7:
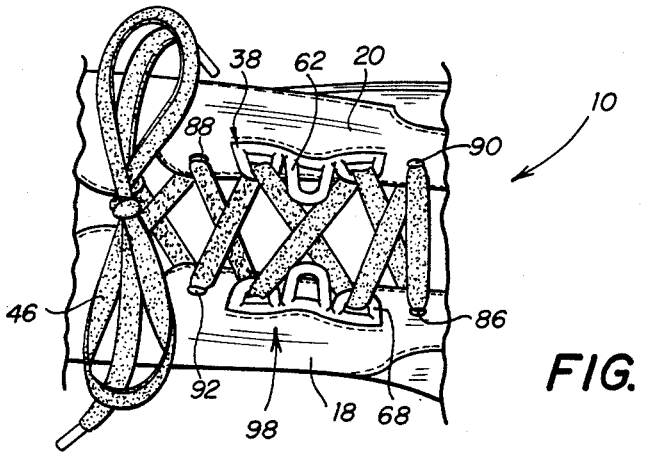
FIG. 7 is a partial plan view of the shoe shown in FIG. 1, showing a third alternate lacing pattern.

FIG. 7 partially shows shoe 10 as laced for a foot having a lower-than-normal instep. Lace 46 is laced from bottom eyelets 86 and 90 through small speed eyelets 68 and finally through top eyelets 88 and 92. Since large speed eyelets 62 are not used in this lacing pattern, lace 46 lies roughly within lower plane 96 (FIG. 4) throughout speed lace section 98. Right quarter 18 is therefore joined by lace 46 to left quarter 20 at a relatively low location, which in turn allows shoe 10 to better fit a foot with a low instep.

In order for eyelets 62 to remain in a higher position than eyelets 68 even when the foot flexes, eyelet-bearing members 38 and 42 should be sufficiently rigid to maintain their shapes against bending stress. This will enhance the anti-friction effect illustrated in FIGS. 3 and 4 by keeping plane 94 separated from plane 96.

Although the exemplary embodiment shown concerns an athletic shoe with a speed lace section, the invention is not limited to athletic shoes. The provision of eyelets in a staggered manner may be used in any laced shoe where friction between one lace portion and another overlapping lace portion is desired to be minimized, and may likewise be provided in any laced shoe where an adjustment for a low or a high instep is desired.

Combinations of the lacing patterns exemplified by FIGS. 1,3,5,6 and 7 may be employed to obtain the best the best possible fit, especially in shoes having an integral section of four or more speed eyelet pairs. For example, where the forward portion of a foot's instep is relatively high but the rearward portion of the instep is relatively low, the wearer may lace the forward portion of a speed lace eyelet section in the pattern shown in FIG. 5, but shift to the pattern shown in FIG. 7 for the rear portion of the speed lace section.

Staggered speed eyelets may be advantageously provided for any shoe with a large number of eyelet pairs that consequently make the job of lacing up the shoe difficult. The invention described herein is useful for providing eyelets for hiking shoes, work boots and the like. Therefore, although an illustrated embodiment of the invention has been described in detail, it should be understood that various changes, substitutions and alterations can be made therein without departing from the spirit and scope of the invention, which are defined by the appended claims.

What is claimed is:

1. A shoe having a right quarter, a left quarter, and a shoelace to bind said right quarter to said left quarter comprising:

an integral right eyelet-bearing member and an integral left eyelet-bearing member each formed of rigid material, said right eyelet-bearing member being attached to an upper portion of said right quarter, said left eyelet-bearing member being attached to an upper portion of said left quarter, said left and right eyelet-bearing members forming an integral section of eyelets;

said left and right eyelet-bearing members each having an arcuate base member having a hill and two ends, a first eyelet being upstandingly formed on each hill and, a second eyelet being upstandingly formed adjacent each end;

said first eyelet having an interior diameter in an upward direction greater than a corresponding interior diameter of said second eyelet, said first and second eyelets having interiors large enough to loosely receive a lace;

each of said second eyelets having upward interior portions within a plane and each of said first eyelets having upward interior portions spaced above said plane to give a better fit to feet with either high or low insteps.

2. The laced shoe eyelet pairs of claim 11 wherein said first eyelets of said first and second sets are directly disposed across from one another in the laced shoe.

3. The laced shoe eyelet pairs of claim 11, wherein the interior of each eyelet has an upward portion, said second eyelet upward portions being within a plane, said first eyelet upward portions being vertically spaced from said plane.

4. The laced shoe of claim 3, further including a lace having a first portion and a second portion;

said first portion being laced into said shoe using said first eyelets and not using said second eyelets;

said second portion being laced into said shoe using second eyelets and not using said first eyelets;

said second portion being generally within said plane and said first portion being generally above said plane after said lace has been drawn taut, said vertical spacing between said first eyelet upward portions and said plane reducing friction between said first portion and said second portion during tightening of the lace.

5. The laced shoe of claim 3, further including:

a lace laced into said shoe using said first eyelets and not said second eyelets.

6. The laced shoe of claim 5, wherein said first eyelet upward portions are spaced above said plane, said first and second sets of eyelets forming an integral eyelet section;

said lace being roughly disposed above said plane at said first eyelets and joining said left quarter to said right quarter at a relatively high location in order to best fit a foot having a high instep.

7. The laced shoe of claim 3, further including:

a lace laced into said shoe using said second eyelets and not said first eyelets.

8. The laced shoe of claim 7, wherein said first and second eyelets form an integral eyelet section;

said lace being roughly disposed within said plane within said eyelet section and joining said left quarter to said right quarter at a relatively low location in order to best fit a foot having a low instep.

9. The shoe of claim 1, wherein said lace includes a a first portion and a second portion;

said first portion being laced into the shoe using said first eyelets and not said second eyelets and being roughly disposed above said plane within said integral eyelet section;

said second portion being laced into the shoe using said second eyelets and not said first eyelets and being roughtly disposed within said plane within said integral eyelet section;

said spacing between said first upward interior portions and said plane reducing friction between said first portion and said second portion as said lengths are pulled tight.

10. The shoe of claim 1, wherein:

said lace is laced into said integral eyelet section using said first eyelets and not said second eyelets, said left quarter being joined along said integral eyelet section to said right quarter at a relatively high position in order to best fit a foot with a high instep.

11. The shoe of claim 1, wherein:

said lace is laced into said integral eyelet section using said second eyelets and not said first eyelets, said left quarter being joined along said integral eyelet section to said right quarter at a relatively low position in order to best fit a foot with a low instep.

12. A method of lacing a shoe having a left quarter, a right quarter and a lace, the steps of:

forming a set of right eyelets and a set of left eyelets for the lace, each eyelet having an interior with an upper portion, the right eyelets integrally formed on a substantially rigid base member attached to an upper portion of the right quarter, the left eyelets integrally formed on a substantially rigid base member attached to an upper portion of the left quarter;

providing alternating first eyelets and second eyelets for each set of eyelets, a pair of left and right first eyelets with enlarged interior diameters in an upward direction being disposed between adjacent pairs of left and right second eyelets;

choosing either the first eyelets or the second eyelets for use in lacing the left quarter to the right quarter;

if the first eyelets are chosen, lacing the left quarter to the right quarter using the first eyelets and not the second eyelets in order to join the left quarter to the right quarter at a relatively high position in order to fit a foot with a high instep; and if the second eyelets are chosen, lacing the left quarter to the right quarter using the second eyelets and not the first eyelets in order to join the left quarter to the right quarter at a relatively low position in order to fit a foot with a low instep.

* * * * *

UNITED STATES PATENT AND TRADEMARK OFFICE

CERTIFICATE OF CORRECTION

PATENT NO. : 4,670,949

DATED : June 9, 1987

INVENTOR(S) : James C. Autry

It is certified that error appears in the above-identified patent and that said Letters Patent is hereby corrected as shown below:

Col. 5, line 25, "claim 11" should be --claim 1--;
line 28, "claim 11" should be --claim 1--.

Signed and Sealed this

Twenty-ninth Day of September, 1987

*Attest:*

DONALD J. QUIGG

*Attesting Officer* *Commissioner of Patents and Trademarks*